US011091714B2

(12) United States Patent
Kashio et al.

(10) Patent No.: US 11,091,714 B2
(45) Date of Patent: Aug. 17, 2021

(54) FUEL OIL "A" COMPOSITION

(71) Applicant: SHELL OIL COMPANY, Houston, TX (US)

(72) Inventors: Tsuyoshi Kashio, Tokyo (JP); Ayumi Takahashi, Kanagawa (JP); Yasuyuki Komatsu, Tokyo (JP)

(73) Assignee: SHELL OIL COMPANY, Houston, TX (US)

( * ) Notice: Subject to any disclaimer, the term of this patent is extended or adjusted under 35 U.S.C. 154(b) by 314 days.

(21) Appl. No.: 16/066,204

(22) PCT Filed: Dec. 14, 2016

(86) PCT No.: PCT/US2016/066505
§ 371 (c)(1),
(2) Date: Jun. 26, 2018

(87) PCT Pub. No.: WO2017/116704
PCT Pub. Date: Jul. 6, 2017

(65) Prior Publication Data

US 2020/0277536 A1 Sep. 3, 2020

(30) Foreign Application Priority Data

Dec. 28, 2015 (JP) ..... JP2015-257135

(51) Int. Cl.
*C10L 1/24* (2006.01)
*C10L 1/04* (2006.01)
*C10L 1/16* (2006.01)

(52) U.S. Cl.
CPC ..... *C10L 1/245* (2013.01); *C10L 1/04* (2013.01); *C10L 1/16* (2013.01); *C10L 2200/0259* (2013.01); *C10L 2200/0263* (2013.01)

(58) Field of Classification Search
CPC .... C10L 1/245; C10L 1/04; C10L 1/16; C10L 1/08; C10L 2200/0259; C10L 2200/0263
See application file for complete search history.

(56) References Cited

FOREIGN PATENT DOCUMENTS

| | | | | | |
|---|---|---|---|---|---|
| CN | 101113346 | A | | 1/2008 | |
| CN | 101426888 | A | | 5/2009 | |
| JP | H10168464 | A | | 6/1998 | |
| JP | 2001279272 | A | | 10/2001 | |
| JP | 2003313565 | A | | 11/2003 | |
| JP | 2004091676 | A | | 3/2004 | |
| JP | 2010265384 | A | * | 11/2010 | |
| JP | 5049998 | B2 | * | 10/2012 | ..... B01J 20/165 |
| JP | 2013216791 | A | * | 10/2013 | |
| WO | 2015052261 | A1 | | 4/2015 | |

OTHER PUBLICATIONS

Man, "Operation on Low-Sulphur Fuels—MAN B&W Two-stroke Engines", MAN Diesel & Turbo, Nov. 12, 2015, available on webpage: https://marine.mandieselturbo.com/docs/librariesprovider6/technical-papers/operation-on-low-sulphur-fuels.pdf?sfvrsn=20 (retrieved on Feb. 15, 2017), 24 pages, XP055346363.

International Search Report and Written Opinion received for PCT Patent Application No. PCT/US2016/066505, dated Feb. 28, 2017, 9 pages.

"Low-sulphur fuels explained", Gard News 209, Feb./Apr. 2013, 2 pages of original document and 5 pages of English translation, total 7 pages.

* cited by examiner

*Primary Examiner* — Latosha Hines
(74) *Attorney, Agent, or Firm* — Shell Oil Company

(57) ABSTRACT

A fuel oil "A" composition wherein the density (15C) is 0.8400 to 0.8900 g/cm3, the kinematic viscosity at 50 C is not less than 2.000 mm2/s and the cetane index (old) is not less than 35, and also wherein the sulphur content is not more than 0.100 mass %, the sulphur content of sulphur compounds having a boiling point at or above the boiling point of dibenzothiophene is not more than 110 mass ppm, and the residual carbon content of 10% residual oil is not less than 0.20 mass %.

11 Claims, No Drawings

FUEL OIL "A" COMPOSITION

CROSS REFERENCE TO RELATED APPLICATIONS

This is a national stage application of International Application No. PCT/US2016/066505, filed 14 Dec. 2016, which claims benefit of priority to Japanese Patent Application No. 2015-257135, filed 28 Dec. 2015.

TECHNICAL FIELD

The present disclosure relates to a heavy fuel oil "A" composition for marine use or the like.

BACKGROUND

Measures to cope with environmental problems have so far put the emphasis on exhaust gases from automotive vehicles and factories, where emissions are major. In recent years, however, there has been a demand also for improvements in exhaust gases from maritime transport, which has been considered to be energy efficient and to have relatively low emissions. Regulations on sulphur contents in marine fuels are therefore being developed in order mainly to reduce the amounts of sulphur oxides (SOx) and black smoke emitted from ships (see Ministry of Land, Infrastructure, Transport and Tourism, Maritime Bureau, "Maritime Report 2014, Ships move, the world moves", Part 1, Important problems in maritime administration, Chapter 9: Tackling environmental problems (hereinafter *Maritime Report* 2014; and Low-sulphur fuels explained (Japanese edition), Gard News 209, February/April 2013, p. 4-5).

Since sulphur oxides and particulate matter originate from the sulphur contained in fuels (*Maritime Report* 2014), fuels for ocean-going vessels which currently use fuels with a sulphur content of 3.5 mass % will in 2020 or 2025 be obliged to have sulphur contents of not more than 0.5 mass %, and sulphur contents of not more than 0.1 mass % in coastal or bayside areas of California or Europe.

In compliance with the sulphur-content regulations, lighter oil fractions are now being used in Europe and elsewhere in maritime use in place of fuel oil "C", which has a high sulphur content. However, in Japan, for example, it is also possible to use heavy oil "A". Hitherto, whenever vessels using fuel oil "C" have changed over to fuel oil "A", there has been concern in particular over wear of fuel injection pumps, because lubrication qualities are reduced.

As regards examples of technologies relating to fuel oil "A", Japanese Patent 2004-91676 has disclosed the use of a petroleum resin as a blending component imparting residual carbon content to give from 0.2 mass % to 0.5 mass % carbon residue content of 10% residual oil and an ASTM colour of not more than 1.5, so as to produce good filterability properties of a fuel oil "A" composition.

Also, Japanese Patent 2001-279272 has disclosed compositions made to possess good starting performance when used for internal combustion engines and external combustion equipment or the like, under low seasonal temperatures in winter or in low-temperature environments in cold regions, by making the FIA cetane number not less than 35, the aromatic content 25 to 50 vol %, the 90% distillation temperature not more than 390° C. and the kinematic viscosity at 50° C. not more than 3.5 mm2/s In addition, Japanese Patent 2003-313565 has disclosed an environmentally benign fuel oil "A" having superior combustion performance and low sulphur and nitrogen contents, with satisfactorily dispersed residual carbon components and free of sludge formation, by making the sulphur content not more than 300 ppm, the nitrogen content not more than 100 ppm, the aniline point not more than 81 and the content of aromatics with 9 carbons 3 to 10 vol %.

SUMMARY

Up to now, there have not been any instances of fuel oil "A" with superior filterability properties and ignition qualities while maintaining lubrication qualities. Methods of coping with this by using additives such as lubricity improvers have been considered as in light oils, but there is the problem of compatibility with low-cost fuel oil "A" or residual carbon, and so adding lubricity improvers is not really a favourable response.

The present disclosure provides a fuel oil "A" composition with a low sulphur content, good lubrication qualities, superior ignition qualities and good filterability properties.

By dint of repeated and intensive investigations, the inventors have discovered a fuel oil "A" composition with good lubrication qualities, superior ignition qualities and good filterability properties even though it has a low sulphur content. In particular, the present disclosure provides for a fuel oil "A" composition wherein the density (15° C.) is 0.8400 to 0.8900 g/cm$^3$, the kinematic viscosity at 50° C. is not less than 2.000 mm$^2$/s and the cetane index (old) is not less than 35, and also wherein the sulphur content is not more than 0.100 mass %, the sulphur content of sulphur compounds having a boiling point at or above the boiling point of dibenzothiophene is not more than 110 mass ppm, and the residual carbon content of 10% residual oil is not less than 0.20 mass %.

Other advantages and features of embodiments of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION

The present disclosure relates a fuel oil "A" composition which, even with a low sulphur content, has high lubricity, superior ignition qualities and good oil filterability properties.

The fuel oil "A" described herein has a density (15° C.) of 0.8400 to 0.8900 g/cm$^3$, but preferably 0.8500 to 0.8900 g/cm$^3$, more preferably 0.8600 to 0.8850 g/cm$^3$, and yet more preferably 0.8600 to 0.880 g/cm$^3$. If the density is too low, fuel consumption will deteriorate, and if the density is too high, the black smoke in the emissions may increase and the cetane index will fall to the detriment of the ignition qualities.

Optionally, the fuel oil "A" composition of the present disclosure can have kinematic viscosity at 50° C. of not less than 2.000 mm$^2$/s, but preferably is 2.000 to 5.000 mm$^2$/s, more preferably 2.400 to 4.000 mm$^2$/s, and yet more preferably 2.400 to 3.800 mm$^2$/s. If the kinematic viscosity at 50° C. is too low, lubrication performance will deteriorate, and if the kinematic viscosity is too high, the atomisation conditions within the combustion engine will deteriorate and emissions may also worsen.

The cetane index (old) of the fuel oil "A" composition provided herein is optionally not less than 35, but is preferably not less than 40, and more preferably not less than 45. The cetane index (new) is preferably not less than 35, more preferably not less than 40 and yet more preferably not less than 45. The cetane index being too low is not desirable from the standpoint of ignition qualities, and if it is too high, it is possible that emissions may worsen, for example unburnt hydrocarbons are likely to result, and so it is preferably not more than 55.

As regards the distillation characteristics of the fuel oil "A" composition of this disclosure, the initial boiling point is preferably not less than 140° C. and more preferably not less than 160° C. The 10% distillation temperature is preferably not less than 210° C., more preferably not less than 220° C. and yet more preferably not less than 230° C., with 240° C. being especially preferred. If the initial boiling point and 10% distillation temperature are too low, the flash point and kinematic viscosity become low and lubrication qualities may deteriorate. Also, if the initial boiling point and 10% distillation temperature are too high, the kinematic viscosity will increase and the appropriate flow characteristics and atomisation state within the engine will deteriorate, so that the initial boiling point is preferably not more than 250° C. and the 10% distillation temperature not more than 270° C. The 50% distillation temperature is preferably 260 to 300° C. but can more preferably be 270 to 290° C. If the 50% distillation temperature is too low, there may be an effect on fuel consumption and ignition qualities, and if it is too high, there is a possibility that low-temperature flow characteristics will deteriorate. The 90% distillation temperature is preferably 300 to 380° C. but can more preferably be 320 to 360° C. and yet more preferably 320 to 350° C. If the 90% distillation temperature is too low, there may be an effect on ignition qualities, and if it is too high, there is a possibility that low-temperature flow characteristics will deteriorate or that black smoke in the combustion exhaust gases will increase.

Optionally, the fuel oil "A" composition of this disclosure has a sulphur content of not more than 0.100 mass %, but is preferably 0.010 to 0.100 mass %. The sulphur component is a cause of environmental pollution and so should preferably be small. However, if the sulphur content is too low, lubrication qualities will generally be reduced.

As regards the sulphur component, the sulphur content of sulphur compounds having a boiling point at or above the boiling point of dibenzothiophene is not more than 110 mass ppm in the fuel oil "A" of this disclosure, but is preferably 30 to 100 mass ppm and more preferably 30 to 80 mass ppm. If it is too high, lubricity deteriorates and if it is too low, production costs increase, or gummy matter may have a detrimental effect. As examples of sulphur compounds having a boiling point at or above the boiling point of dibenzothiophene, mention may be made of dibenzothiophene, 4-methyldibenzothiophene and 4,6-dimethyldibenzothiophene. The boiling point of dibenzothiophene is 332.5° C. The sulphur content of sulphur compounds having a boiling point at or above the boiling point of dibenzothiophene can be measured by means of gas chromatography, using a gas chromatograph fitted with a sulphur chemiluminescence detector.

The sulphur content of sulphur compounds having a boiling point below the boiling point of dibenzothiophene in the fuel oil "A" composition of this disclosure is preferably 2 to 40 mass ppm, but more preferably 5 to 30 mass ppm. As examples of sulphur compounds having a boiling point below the boiling point of dibenzothiophene, mention may be made of thiophene and benzothiophene. The sulphur content of sulphur compounds having a boiling point below the boiling point of dibenzothiophene can be measured by means of gas chromatography, using a gas chromatograph fitted with a sulphur chemiluminescence detector.

The sulphur content after the 95% cut is preferably not less than 0.15 mass %, but is more preferably not less than 0.20 mass %. If this value is too small, there is a possibility that lubricity will deteriorate, and if it is too high, there is a possibility that oil filterability may deteriorate, and so it is preferably not more than 0.40 mass %, but more preferably not more than 0.30 mass %.

Optionally, the residual carbon of 10% residual oil contained in the fuel oil "A" composition of this disclosure is not less than 0.20 mass %, but preferably not less than 0.25 mass %, and more preferably not less than 0.30 mass %. If this value is large, lubricity becomes better, but if it is too high, oil filterability will deteriorate, and so it is preferably not more than 0.70 mass %, but more preferably not more than 0.50 mass % and yet more preferably not more than 0.40 mass %.

The total aromatic content of the fuel oil "A" composition of this disclosure is preferably not less than 25.0 vol %, but more preferably not less than 30.0 vol % and yet more preferably not less than 40.0%, but especially preferable is not less than 45.0 vol %. At high levels, lubricity and oil filterability are good but if it is too high the cetane index will be reduced and trouble may occur in engines such as poor startability, and so it is preferably not more than 55.0 vol %, but more preferably not more than 50.0 vol %. The total aromatic component includes monocyclic aromatics having alkyl groups or naphthene rings on benzene, bicyclic aromatics having alkyl groups or naphthene rings on naphthalene, and tricyclic aromatics having alkyl groups or naphthene rings on phenanthrene or anthracene. The monocyclic aromatic component is preferably not less than 16.0 vol %, but is more preferably not less than 20.0 vol % and yet more preferably not less than 25 vol %. The bicyclic aromatic component is preferably not less than 5.0 vol %, but is more preferably not less than 15 vol % and yet more preferably not less than 20 vol %. The tricyclic aromatic component is preferably not less than 2.0 vol %, but is more preferably not less than 4.0 vol % and yet more preferably not less than 6.0 vol %. Similarly, if the aromatic component is too small, lubricity and oil filterability may deteriorate, and if it is too high, the cetane index will be reduced and there may be trouble with engine startability or the like. Therefore, it is preferable if the monocyclic aromatic component is not more than 40.0 vol %, if the bicyclic aromatic component is not more than 25.0 vol % and if the tricyclic aromatic component is not more than 8.0 vol %.

The saturated hydrocarbon component of the fuel oil "A" composition of this disclosure can be 40.0 to 70.0 vol %. If the saturated hydrocarbon component is too low, the cetane index will be reduced and trouble may occur in engines such as poor startability. If it is too high, the oil filterability performance may worsen.

Optionally, the olefin component of the fuel oil "A" composition of this disclosure can be up to 0.5 vol %, but is preferably 0.1 to 0.3 vol %. If the olefin component is too small, the low-temperature flow characteristics may worsen, and if it is too high the storage stability will worsen and the oil filterability may deteriorate.

The nitrogen content of the fuel oil "A" composition of this disclosure can be preferably 0.005 to 0.05 mass %, but more preferably 0.005 to 0.03 mass % and yet more preferably 0.01 to 0.03 mass %. If the nitrogen component is too small, the lubricity may worsen and if it is too high, there may be an increase in nitrogen oxides during combustion.

The HFRR of the fuel oil "A" composition of this disclosure based on ISO 12156-1 (out of the tests specified for testing lubricity of light oils, an HFRR test is carried out with a load of 1000 gf, assuming the use of marine injection pumps, and the wear scar diameter on a fixed steel ball is measured to evaluate lubrication performance) is preferably no more than 470 μm, but is more preferably not more than 450 μm and yet more preferably not more than 415 μm. The net calorific value is preferably 36,000 to 38,000 KJ/L, but is more preferably 36,500 to 37,600 KJ/L.

In general, fuel oil "A" is produced by mixing it with a plurality of blending components and additives such as low-temperature flow improvers, but with the fuel oil "A" composition of this disclosure, when mixing it with blending components and additives, it is preferable not to add lubricity improvers.

The fuel oil "A" composition of this disclosure is preferably to be used as a fuel for ships.

The composition finally obtained for the fuel oil "A" composition of this disclosure can be adjusted, so as to have the special characteristics stipulated, by adding a residual carbon modifier to a mixture of one kind or two or more kinds of kerosene or light oil blending components obtained by distillation, desulphurisation and cracking treatments on crude oil. For example, it is possible to use kerosene fractions or light oil fractions, or desulphurised forms thereof, which are desulphurised kerosene or desulphurised light oil, obtained by atmospheric distillation of crude oil. It is also possible to use a diesel oil fuel composition obtained by a desulphurisation treatment and mixing, in suitable proportions, a light oil fraction obtained from atmospheric distillation apparatus and a cracked light oil. What is meant by a cracked light oil is a light oil fraction distilled from heavy fuel oil upgrading processes, such as a directly desulphurised light oil obtained from direct desulphurisation apparatus, a indirectly desulphurised light oil obtained from indirect desulphurisation apparatus or a catalytically cracked light oil obtained from fluid catalyst cracking apparatus.

While the invention is susceptible to various modifications and alternative forms, specific embodiments thereof are shown by way of examples herein described in detail. It should be understood, that the detailed description thereto are not intended to limit the invention to the particular form disclosed, but on the contrary, the intention is to cover all modifications, equivalents and alternatives falling within the spirit and scope of the present invention as defined by the appended claims. The present invention will be illustrated by the following illustrative embodiment, which is provided for illustration only and is not to be construed as limiting the claimed invention in any way.

The person skilled in the art will readily understand that, while the invention is illustrated making reference to one or more a specific combinations of features and measures, many of those features and measures are functionally independent from other features and measures such that they can be equally or similarly applied independently in other embodiments or combinations.

ILLUSTRATIVE EMBODIMENTS

Examples of Embodiment 1-5, Comparative Examples 1-3

The fuel oil "A" compositions of Examples of Embodiment 1 to 5 and Comparative Examples 1 to 3 were obtained by mixing the blending components shown in Table 1 in the volumetric ratios shown in Table 2. The properties shown in Tables 1 and 3 were measured as described below.

Density (15° C.): Measured in accordance with JIS K 2249 "Crude oil and petroleum products—Determination of density and density/mass/volume conversion tables."

ASTM distillation: Measured in accordance with JIS K 2254 "Petroleum products—Distillation test methods, 4. Atmospheric distillation test method."

Cetane index (new): Measured in accordance with the method for determination of research octane number of JIS K 2280-5 "Petroleum products—Fuel oils—Determination of octane number and cetane number, and method for calculation of cetane index, Part 5: Cetane index."

Cetane index (old): Means cetane index obtained in accordance with JIS K 2204-1992 "Diesel fuel."

Residual carbon in 10% residual oil: Measured in accordance with JIS K 2270 "Crude oil and petroleum products—Determination of residual carbon."

Viscosity (30° C.)/(50° C.): Measured in accordance with JIS K 2283 "Crude petroleum and petroleum products—Determination of kinematic viscosity and calculation of viscosity index from kinematic viscosity."

Saturated hydrocarbons, olefins, aromatics: Measured in accordance with JPI-5S-49-97 "Petroleum products—Determination of hydrocarbon types—High performance liquid chromatography method."

Nitrogen content: Measured by the chemiluminescence method of JIS K 2609 "Crude petroleum and petroleum products—Determination of nitrogen content."

Sulphur content: Measured in accordance with JIS K 2541-4 "Crude oil and petroleum products—Determination of sulphur content, Part 4: X-ray fluorescence method."

Sulphur compounds having a boiling point below the boiling point of dibenzothiophene: Gas chromatography measurements were made using a gas chromatograph apparatus of Agilent make fitted with a sulphur chemiluminescence detector. The column used was a B-Sulfur SCD by J&W. Measurements were made after dissolving dibenzothiophene in special-grade hexane and the retention times were assigned to the solute peaks. Calibration curves were also prepared for dibutyl sulphide as a reference substance. Next, the sample was measured and the amount of sulphur in the fuel oil "A" composition for the sulphur compounds having a boiling point below the boiling point of dibenzothiophene was obtained by quantification of the total area of the peaks located before the peak retention time of the dibenzothiophene, using the dibutyl sulphide calibration curves. The gas chromatograph measurement conditions were 3 minutes hold at 35° C., then a temperature rise to 150° C. at 5° C./minute, and then a temperature rise to 270° C. at 10° C./minute, with a hold for 22 minutes.

Sulphur compounds having a boiling point at or above the boiling point of dibenzothiophene: Gas chromatography measurements were made using a gas chromatograph apparatus of Agilent make fitted with a sulphur chemiluminescence detector. The column used was a B-Sulfur SCD by J&W. Measurements were made after dissolving dibenzothiophene in special-grade hexane and the retention times were assigned to the solute peaks. Calibration curves were also prepared for dibutyl sulphide as a reference substance. Next, the sample was measured and the amount of sulphur in the fuel oil "A" composition for the sulphur compounds having a boiling point at or above the boiling point of dibenzothiophene was obtained by quantification of the total area of the peaks located at or after the peak retention time of the dibenzothiophene, using the dibutyl sulphide calibration curves. The gas chromatograph measurement conditions were 3 minutes hold at 35° C., then a temperature rise to 150° C. at 5° C./minute, and then a temperature rise to 270° C. at 10° C./minute, with a hold for 22 minutes.

Sulphur content after 95% cut:

The residual oil after the 95% cut in ASTM distillation was measured in accordance with JIS K 2541-4 "Crude oil and petroleum products—Determination of sulphur content Part 4: X-ray fluorescence method."

Oil filterability: Using the apparatus described in IP387/08 "Determination of filter blocking tendency, Annex A," the test rig was a filter unit of diameter 90 mm The filter was a membrane filter LSWP09025 (made by Merck Ltd). Sample oil was passed through for one hour under conditions of oil temperature 13±1° C. and flow rate 1.0 L/h, and the pressure values after oil had passed through were measured. If the pressure differential after passage of the oil was not more than 0.2 kg/cm$^2$ the evaluation was ⊙, for more than 0.2 kg/cm$^2$ and below 0.7 kg/cm$^2$ it was O, and for 0.7 kg/cm$^2$ and higher it was X.

HFRR: An HFRR test was carried out as one of the tests stipulated in the ISO 12156-1 "Diesel fuel—Assessment of lubricity" test methods, and the sole load was set at 1000 gf. The wear scar diameter of the fixed steel ball is taken as a criterion for evaluating lubrication performance.

Test conditions:
Test ball: Steel bearing (SUJ-2)
Load (P): 1000 gf
Frequency: 50 Hz
Stroke: 1,000 μm
Test duration: 75 minutes
Temperature: 60° C.

Test method: The test sample was put in a test bath and the temperature of the sample was held at 60° C. The test ball was fixed to the test-ball fixing stand attached in a fore and aft alignment. A load (1.96 mN) was applied to a test disc set in a horizontal alignment. With the sample totally submerged in the test bath, it was brought into contact with the test disc and the steel test ball was made to reciprocate (oscillate) at a frequency of 50 Hz. Upon completion of the test, the wear scar on the fixed steel ball (μm) was measured.

Net calorific value:

Calculated in accordance with JIS K 2279 "Crude oil and petroleum products—Method for determination of calorific value and method for estimation by calculation." Since the amounts of ash and moisture necessary for the calculation were trace amounts, the calculation was set at 0 mass %.

Below, Table 1 shows the properties of blending components 1-6. Table 2 shows the amount of the respective blending component used for each Examples of Embodiments 1-5 and Comparative Examples 1-3. Table 3 shows the properties of the Examples of Embodiments 1-5 and Comparative Examples 1-3.

TABLE 1

| | Units | Blending component 1 Cat-cracked light oil | Blending component 2 Directly desulphur-ised light oil | Blending component 3 Desulphur-ised light oil | Blending component 4 Cat-cracked light oil | Blending component 5 Directly desulphur-ised light oil | Blending component 6 Atmospheric residue oil |
|---|---|---|---|---|---|---|---|
| Density (using vibrations) 15° C. | g/cm$^3$ | 0.9526 | 0.8659 | 0.8426 | 0.9574 | 0.8724 | 0.9852 |
| Sulphur content | mass % | 0.086 | 0.054 | 0.0008 | 0.270 | 0.026 | 4.140 |
| Below boiling point of dibenzothiophene *1 | mass ppm | 38 | 0 | 0 | 514 | 0 | — |
| At or above boiling point of dibenzothiophene *2 | mass ppm | 393 | 152 | 0.3 | 879 | 61 | — |
| Kinematic viscosity (@ 30° C.) | mm$^2$/s | 3.616 | 4.509 | 4.390 | 3.728 | 6.353 | — |
| Kinematic viscosity (@ 50° C.) | mm$^2$/s | 2.335 | 2.898 | 2.859 | 2.384 | 2.804 | — |
| Composition: Saturated hydrocarbons | vol % | 17.3 | 59.8 | 72.4 | 14.8 | 59.2 | — |
| Olefins | vol % | 0.2 | 0.0 | 0.0 | 0.8 | 0.0 | — |
| Monocyclic aromatics | vol % | 19.0 | 32.7 | 22.2 | 18.2 | 35.5 | — |
| Bicyclic aromatics | vol % | 47.2 | 4.3 | 3.7 | 49.9 | 3.4 | — |
| Tricyclic aromatics | vol % | 16.3 | 3.2 | 1.7 | 16.3 | 1.9 | — |

*1: Sulphur compounds in blending components having a boiling point below the boiling point of dibenzothiophene

*2: Sulphur compounds in blending components having a boiling point at or above the boiling point of dibenzothiophene —: not measured

TABLE 2

| | Ex. of Emb. 1 | Ex. of Emb. 2 | Ex. of Emb. 3 | Ex. of Emb. 4 | Ex. of Emb. 5 | Comp. Ex. 1 | Comp. Ex. 2 | Comp. Ex. 3 |
|---|---|---|---|---|---|---|---|---|
| Blending component 1 | 30 | 40 | | 10 | | | 60 | |
| Blending component 2 | | | | | | 70 | | |
| Blending component 3 | 70 | 60 | 90 | | 90 | 30 | 40 | 90 |
| Blending component 4 | | | 10 | | 10 | | | 10 |
| Blending component 5 | | | | 90 | | | | |
| Blending component 6 | 0.2 | 0.2 | 0.2 | 0.2 | 0.4 | 0.2 | 0.2 | 0.6 |

TABLE 3

| | | Ex. of Emb. 1 | Ex. of Emb. 2 | Ex. of Emb. 3 | Ex. of Emb. 4 | Ex. of Emb. 5 | Comp. Ex. 1 | Comp. Ex. 2 | Comp. Ex. 3 |
|---|---|---|---|---|---|---|---|---|---|
| Density (using vibrations) 15° C. | $g/cm^3$ | 0.8761 | 0.8869 | 0.8542 | 0.8806 | 0.8547 | 0.8592 | 0.9086 | 0.8545 |
| ASTM distillation: | | | | | | | | | |
| IBP | ° C. | 195.5 | 196.5 | 189.0 | 234.0 | 188.0 | 198.0 | 185.5 | 190.5 |
| T10 | ° C. | 241.0 | 239.0 | 241.5 | 256.0 | 242.5 | 229.0 | 238.5 | 242.5 |
| T30 | ° C. | 263.5 | 262.0 | 266.5 | 274.0 | 266.5 | 264.0 | 260.0 | 266.5 |
| T50 | ° C. | 283.0 | 280.5 | 286.0 | 295.5 | 286.0 | 290.0 | 277.5 | 287.0 |
| T70 | ° C. | 304.5 | 302.5 | 308.0 | 320.5 | 307.5 | 313.5 | 299.0 | 308.5 |
| T90 | ° C. | 335.0 | 333.0 | 339.0 | 351.5 | 339.0 | 343.5 | 331.0 | 340.0 |
| FBP | ° C. | 360.5 | 358.0 | 364.0 | 379.0 | 365.5 | 368.0 | 353.5 | 364.0 |
| Cetane index (new) | — | 42.1 | 38.1 | 50.7 | 43.9 | 50.6 | 47.9 | 31.7 | 50.8 |
| Cetane index (old) | — | 43 | 39 | 52 | 45 | 52 | 51 | 31 | 52 |
| Residual C in 10% residue | mass % | 0.37 | 0.38 | 0.34 | 0.28 | 0.66 | 0.37 | 0.44 | 0.99 |
| Kinematic viscosity @ 30° C. | $mm^2/s$ | 4.047 | 3.983 | 4.302 | 5.913 | 4.331 | 4.490 | 3.907 | 4.377 |
| Kinematic viscosity @ 50° C. | $mm^2/s$ | 2.625 | 2.608 | 2.790 | 3.590 | 2.818 | 2.905 | 2.489 | 2.821 |
| Saturated hydrocarbons | vol % | 56.4 | 50.9 | 67.0 | 54.6 | 67.6 | 63.7 | 39.5 | 67.0 |
| Olefins | vol % | 0.3 | 0.3 | 0.3 | 0.0 | 0.2 | 0.0 | 0.3 | 0.2 |
| Monocyclic aromatics | | | | | | | | | |
| Bicyclic | vol % | 19.8 | 19.7 | 21.3 | 33.9 | 21.5 | 29.6 | 19.4 | 21.5 |
| Polycyclic | vol % | 17.8 | 22.0 | 8.7 | 8.2 | 8.5 | 4.7 | 30.8 | 8.6 |
| Bicyclic + polycyclic | vol % | 5.7 | 7.1 | 2.7 | 3.3 | 2.2 | 2.0 | 10.0 | 2.7 |
| TOTAL | vol % | 23.5 | 29.1 | 11.4 | 11.5 | 10.7 | 6.7 | 40.8 | 11.3 |
| Nitrogen | vol % | 43.3 | 48.8 | 32.7 | 45.4 | 32.2 | 36.3 | 60.2 | 32.8 |
| Sulphur | vol % | 0.02 | 0.03 | 0.0062 | 0.02 | 0.0068 | 0.01 | 0.05 | 0.0074 |
| Below b.p. of DBT *1 | mass ppm | 0.038 | 0.045 | 0.040 | 0.039 | 0.049 | 0.046 | 0.061 | 0.059 |
| At/above b.p. of DBT *2 | mass ppm | 13 | 20 | 33 | 7 | 35 | 0 | 21 | 39 |
| Sulphur after 95% cut | mass % | 74 | 106 | 71 | 55 | 91 | 114 | 241 | 173 |
| Filterability | $kg/cm^2$ | ⊙ | ⊙ | ○ | ⊙ | ○ | ○ | ⊙ | X |
| HFRR (60° C., 1000 g) | | 401 | 371 | 456 | 420 | 435 | 476 | 364 | 443 |
| Net calorific value | KJ/L | 37,181 | 37,519 | 36,476 | 37,323 | 36,490 | 36,637 | 38,184 | 36,481 |

*1: Sulphur compounds in blending components having a boiling point below the boiling point of dibenzothiophene

*2: Sulphur compounds in blending components having a boiling point at or above the boiling point of dibenzothiophene That which is claimed is:

1. A fuel oil "A" composition comprising:

a sulphur content from 0.01 mass % to 0.1 mass %, wherein from 2 mass ppm to 110 mass ppm of the sulphur content has a boiling point at or above the boiling point of dibenzothiophene;

a total aromatic component comprising at least 15 vol % of a bicyclic aromatic component and from 2 vol % to 8 vol % of a tricyclic aromatic component, wherein vol % is based on the volume of the total aromatic component and a residual carbon content of 10% residual oil at a content of no less than 0.2 mass %, wherein the fuel oil "A" composition has a density at a temperature of 15° C. measured in accordance with JIS K 2249 of 0.8400 to 0.8900 g/cm$^3$, wherein the fuel oil "A" composition has a kinematic viscosity at 50° C. that is not less than 2.000 mm$^2$/s, and wherein the fuel oil "A" composition has a cetane index obtained in accordance with JIS K 2204-1992 of not less than 35.

2. The fuel oil "A" composition in accordance with claim 1, wherein the sulphur content of sulphur compounds having a boiling point below the boiling point of dibenzothiophene is 2 mass ppm to 50 mass ppm.

3. The fuel oil "A" composition in accordance with claim 1, wherein the total aromatic component ranges from 25.0 vol % to 55 vol %, by volume of the fuel oil "A" composition.

4. The fuel oil "A" composition in accordance with claim 3, wherein the total aromatic component comprises a monocyclic aromatic component that is not less than 16.0 vol %.

5. The fuel oil "A" composition in accordance with claim 1, wherein the sulphur content after a 95% cut in ASTM distillation is 0.15 mass % to 0.40 mass %.

6. The fuel oil "A" composition in accordance with claim 1, wherein the fuel oil "A" composition is characterized by at least one of:

an initial boiling point that is not less than 140° C.;

a 10% distillation temperature that is not less than 210° C.;

a 50% distillation temperature that is in a range of 260° C. to 300° C.; and a 90% distillation temperature that is in a range of 300° C. to 380° C.

7. The fuel oil "A" composition in accordance with claim 1, wherein the fuel oil "A" composition further comprises a saturated hydrocarbon component is in a range of 40.0 to 70.0 vol %.

8. The fuel oil "A" composition in accordance with claim 1, wherein the fuel oil "A" composition further comprises an olefin component is up to 0.5 vol %.

9. The fuel oil "A" composition in accordance with claim 1, wherein the fuel oil "A" composition further comprises a nitrogen content is in a range of 0.005 to 0.05 mass %.

10. The fuel oil "A" composition in accordance with claim 4, wherein the total aromatic component contains the monocyclic aromatic component ranging from 16.0 vol % to 40 vol %, by volume of the total aromatic component.

11. The fuel oil "A" composition in accordance with claim 1, wherein the total aromatic component contains the bicyclic aromatic component ranging from 15 vol % to 25 vol %, by volume of the total aromatic component.

* * * * *